United States Patent [19]

Gunnerson

[11] 4,169,787

[45] Oct. 2, 1979

[54] APPARATUS AND METHOD FOR LIQUID SEPARATION OF MATERIALS

[75] Inventor: Robert E. Gunnerson, Woodbury, N.J.

[73] Assignee: Campbell Soup Company, Camden, N.J.

[21] Appl. No.: 859,433

[22] Filed: Dec. 12, 1977

[51] Int. Cl.[2] ..... B03B 5/40

[52] U.S. Cl. ..... 209/173

[58] Field of Search ..... 426/481, 484; 209/173, 209/177.5, 156

[56] References Cited

U.S. PATENT DOCUMENTS

| | | | |
|---|---|---|---|
| 1,286,554 | 12/1918 | Dekker | 209/173 |
| 2,054,949 | 9/1936 | Robinson et al. | 209/173 |
| 2,139,047 | 12/1938 | Tromp | 209/173 X |
| 2,150,918 | 3/1939 | Foulke | 209/172 |
| 2,152,143 | 3/1939 | Martin | 209/458 |
| 2,234,502 | 3/1941 | Pixton | 209/173 |
| 2,603,352 | 7/1952 | Tromp | 209/173 X |
| 3,683,945 | 8/1972 | Weisser | 209/156 X |

FOREIGN PATENT DOCUMENTS

| | | | |
|---|---|---|---|
| 858742 | 12/1940 | France | 209/173 |
| 528914 | 11/1940 | United Kingdom | 209/173 |

*Primary Examiner*—Ralph J. Hill

*Attorney, Agent, or Firm*—Paul and Paul

[57] ABSTRACT

An apparatus and method are provided for the liquid separation of materials, and particularly for the separation of edible portions of a material from unedible portions, by utilizing the specific gravity differential between such materials. The materials are thrust into a receptacle which contains a solution of a predetermined density, and are separated into their constituents by subjecting same to an issuing stream of solution produced by jet manifolds. This issuing stream operates with the solution to cause separation of the lighter constituents which float to the upper portion of the receptacle from the heavier constituents which tend to sink in the solution. At least two conveyor belts are provided each being within the solution; the first of which is disposed within the receptacle to receive the lighter constituents and a second disposed below the first to receive the heavier constituents. Both conveyors discharge the respective constituent materials.

19 Claims, 6 Drawing Figures

APPARATUS AND METHOD FOR LIQUID SEPARATION OF MATERIALS

BACKGROUND OF THE INVENTION

1. Field of the Invention

This invention relates generally to devices and methods for the liquid separation of materials based upon differences in specific gravity. Particularly, the invention relates to an apparatus and method for the liquid separation of edible products from unedible portions thereof. Even more specifically, it relates to a liquid separation system for the treatment of raisins, wherein the edible fruit or raisin, is separated from the unedible portion which includes: stems, cap stems, waterberries, mold, and other waste.

2. Prior Art Statement

In the production of raisins, grapes are harvested from the vineyards in bunches and then dried to a moisture content of about 20%. These bunches of dried grapes include waste materials, such as, for example, the dried vines, stems, mold, and the like. The product is then transported to storage areas where it is fumigated and dried until the fruit has a moisture content of approximately 14%. The storage areas are generally fabricated of wood, and therefore, the waste materials further include wood particles which become matted into the fruit. The grapes are then processed in a series of mechanical operations designed to separate the fruit from a majority of the waste materials utilizing tumblers, rollers, water baths, etc. The product is then passed through a fluming station and thereafter, ready to be finally treated to produce a product suitable for commercialization.

In processing the edible and unedible materials, as above, it has been customary to employ laborers to remove such waste materials from the finally processed raisin. A number of hand sorters remove the unedible materials as the fruit and waste materials are transported as for example, by shaker screens, conveyors, and the like. Hand sorting, today, has become unfeasible due to prohibitive labor expenses and more exacting standards, including more stringent specifications as to the content of fruit sold to consumers (where only several parts per thousand waste in the commercial product is permitted). Moreover, the present production techniques which utilize high velocity air currents followed by water baths do not produce commercially acceptable raisins. It has therefore become increasingly important to develop improved mechanical devices to perform the above type separation in a more efficient and economical manner.

While some of the prior art is directed to the general principle of separating edible portions of fruit from unedible portions and other waste materials, it is in large part directed to separation by means of mechanical abrasion between concentric tubular members, interacting fruit between tubular members or rolls, or utilizing fan blades and the like to impel the raisins into a wall, against other raisins, or into baffles, screens, and the like.

The general principle of floation separation of frost damaged citrus fruit from undamaged citrus fruit is known. See for example: U.S. Pat. No. 994,654—issued to Parker and U.S. Pat. No. 2,283,512—issued to Sias.

U.S. Pat. No. 2,152,143, issued to Martin, is directed to sluicing raisins through a riffled structure of a hydraulic separator where stones and heavier particles (including raisins) drop out and fragments, such as cap stems, float toward the top of a water bath.

U.S. Pat. No. 1,269,966, issued to Shepard is directed to the treatment of raisins by immersing same in a body of water which is agitated by a worm gear, the latter of which mechanically interacts with the raisins to dislodge the cap stems. The raisins and heavier foreign materials are conveyed by the worm gear through a section of the tank where the heavier materials are pumped out and into a second stage of the apparatus for further treatment utilizing an agitating screen and pressurized fluid sprays. This process ultimately relies upon a screening process for the final separation of the fruit from the waste materials.

In U.S. Pat. No. 1,754,923, issued to Weigand, a liquid separation technique is utilized to separate prunes into various qualities and grades by progressively subjecting them to more dense solutions.

The prior art does not provide a suitable apparatus and method for the liquid separation of materials which is highly efficient and economical and which is compatible with present processing techniques and may be incorporated "in-line" to treat commercial quantities of materials. Moreover, the known prior art techniques have been proven to be unacceptable in the separation of raisins from stems, cap stems, waterberries, mold, wood chips, and other waste.

Accordingly, an apparatus and method is needed to meet todays standards in providing commercial quantities, of product free of mold, substandards, and other unedible waste materials. The present invention fills such a need by providing a means to treat and process free flowing raisins at acceptable standards and at feed rates incurred in production type "in-line" processes. Bulk materials are thrust into a solution of predetermined density and then reacted with an issuing stream of solution which combines to separate the materials. Conveyors are provided to transport the respective constituents, above, from the receptacle for disposal or further treatment. The present invention comtemplates the separation of various materials utilizing specific gravity differentials, and is specifically directed to the separation of edible materials from unedible materials including waste. While the invention is specifically described with reference to the processing of raisins, it is to be understood that the apparatus and principles relative thereto can equally be applied to promote separation of various types of materials including, for example, the separation of poultry from bones and gristle, green beans from stems and leaves, peas from pods and stems, and the like.

SUMMARY OF THE INVENTION

The concept of the present invention resides in the utilization of a device to provide a sufficient quantity of free flowing materials which may include raisins, waterberries, stems, cap stems, mold, wood chips, and other waste materials, at a uniform rate and in a uniform manner into a container of solution having a predetermined density. The materials are thrust into the solution with sufficient velocity to disperse the materials, breaking them apart, and dispersing same within the solution where spray manifolds impart an issuing stream of the solution within the container and underneath the level of solution which impinges upon the materials, and in fact, may be adjusted to facilitate the separation of the materials into constituent parts.

This concept is effected by an apparatus which includes feed means disposed at a predetermined height above the solution and over the receiving portion of the receptacle. The feed means function to discharge the materials into the receptacle at a uniform rate and in a uniform manner. The receptacle comprises a container having a receiving portion and a discharge portion and contains a homogeneous solution of predetermined density which in most instances is a saccharide solution. The receptacle is provided with manifold means in operative engagement with the receiving portion of the receptacle and located beneath the solution level for issuing a stream of solution toward the discharge portion of the receptacle at a rate of flow which is substantially uniform throughout the width of the receptacle. The manifold means additionally includes adjustment means operably engaging the manifold for varying the direction of the issuing stream of solution, flow rate means operably engaging the manifold for varying the uniform flow rate of the issuing stream of solution, and suction means in fluid engagement with the receptacle and the manifold means for removing the solution from the receptacle and distributing same to the manifold at a predetermined rate. First conveyor means is provided and disposed in the discharge portion of the receptacle, the receiving portion of which is submerged in the solution at a point just below the solution level such that the waterberries, mold, stems, cap stems, and other waste materials, lighter than the raisins, are removed. For purposes of more actively controlling the types of materials selectively removed from the solution, adjustable plow means is provided. The adjustable plow means is operatively engaged with the receiving portion of the first conveyor means and is utilized to remove materials which would otherwise flow below the first conveyor means. Additionally, a second conveyor means disposed below the first conveyor means and located in the discharge portion of the receptacle, is provided, for removal of the fruit or raisins. The apparatus as thus described, and especially, the issuing stream adjustment means, the flow rate means, and the plow means, are separately adjustable or may be adjusted in any combination while "in-line" to improve separation of and between the raisins and the waste materials.

The present invention provides a method for the separation of the above materials by thrusting the materials into a solution having a specific gravity greater than that of the waste materials, simultaneously subjecting the materials to an issuing stream maintained at a flow rate which is substantially uniform throughout the receptacle and removing the materials by first and second conveyor means, whereupon the waste materials may be disposed or stored and the raisins be conveyed "in-line" for further processing. The process results in the processing of commercial quantities of clean raisins due to the highly efficient removal of waste materials. It has been found that a solution recovery system may be added to the apparatus to more economically operate the present invention.

BRIEF DESCRIPTION OF THE DRAWINGS

These and other objects and advantages of the present invention will become more readily apparent upon reading the following specification which describes an illustrative embodiment of the invention, along with the accompanying claims and drawings in which:

DESCRIPTION OF THE PREFERRED EMBODIMENT

The Apparatus

Figure 1:
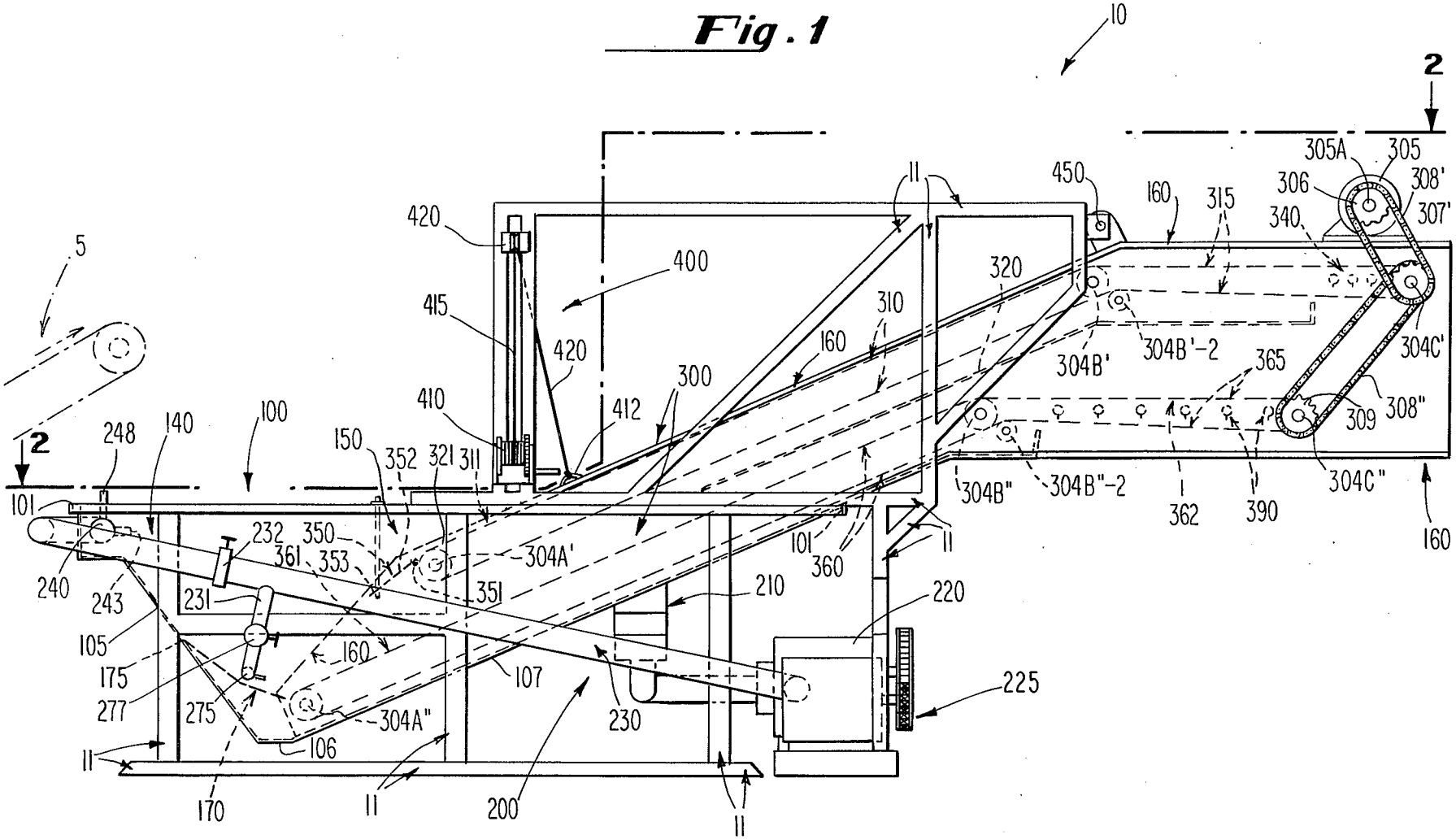
FIG. 1 is a side view of the apparatus of the present invention.
Figure 6:
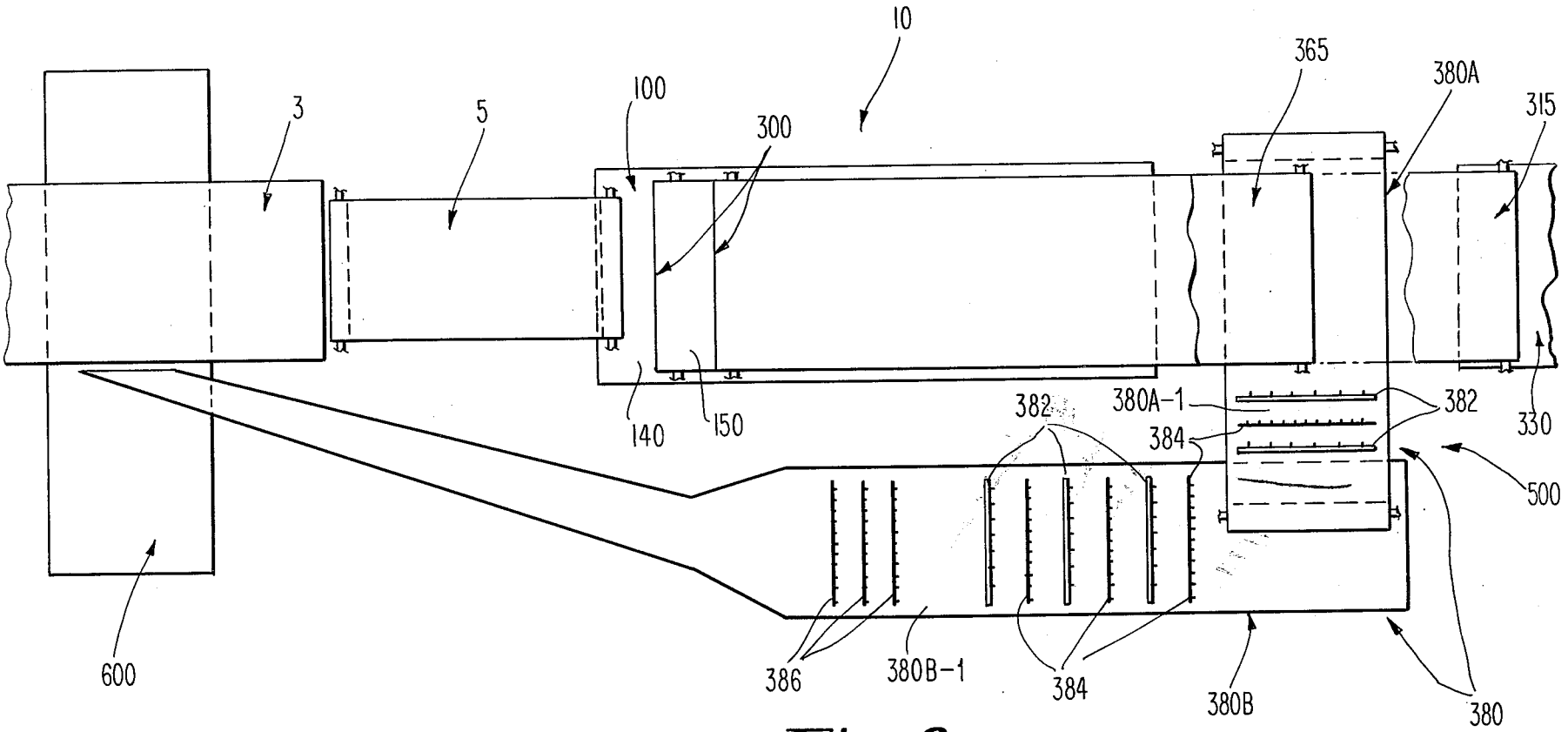
FIG. 6 is a schematic presentation of a raisin processing system equipped with a solution recovery system all of which carries out the method of the present invention.

Referring to FIGS. 1 and 6, reference numeral 10 refers generally to the apparatus of the present invention which is utilized to carry out the method of the present invention.

More specifically, apparatus 10 is supported by frame 11 which is fabricated of structural steel and used to support apparatus 10 in a stable manner. Apparatus 10 includes receptacle 100, recirculating system 200, and conveyor system 300. It may optionally include solution recovery system 500. In the preferred embodiment, the portions which contact edible materials, or recirculate solution are preferably fabricated of stainless steel.

Receptacle 100 is a container for holding solution 20 and comprises, rails 101 which are integral with two side members 102, receiving floor 105 and discharge floor 107. Receptacle 100 is further divided into a receiving portion 140 and a discharge portion 150, as described more fully hereinbelow. Beginning with receiving portion 140, receptacle 100 forms a container comprising receiving floor 105 integral with side members 102 the former of which slopes generally downwardly from rails 101 and is integral with floor 106. Floor 106 is integral with discharge floor 107, which slopes increasingly upwardly from floor 106 and is integral with rails 101. Receptacle 100 as thus far described forms a container for holding solution 20 which is more fully described hereinbelow.

Figure 4:
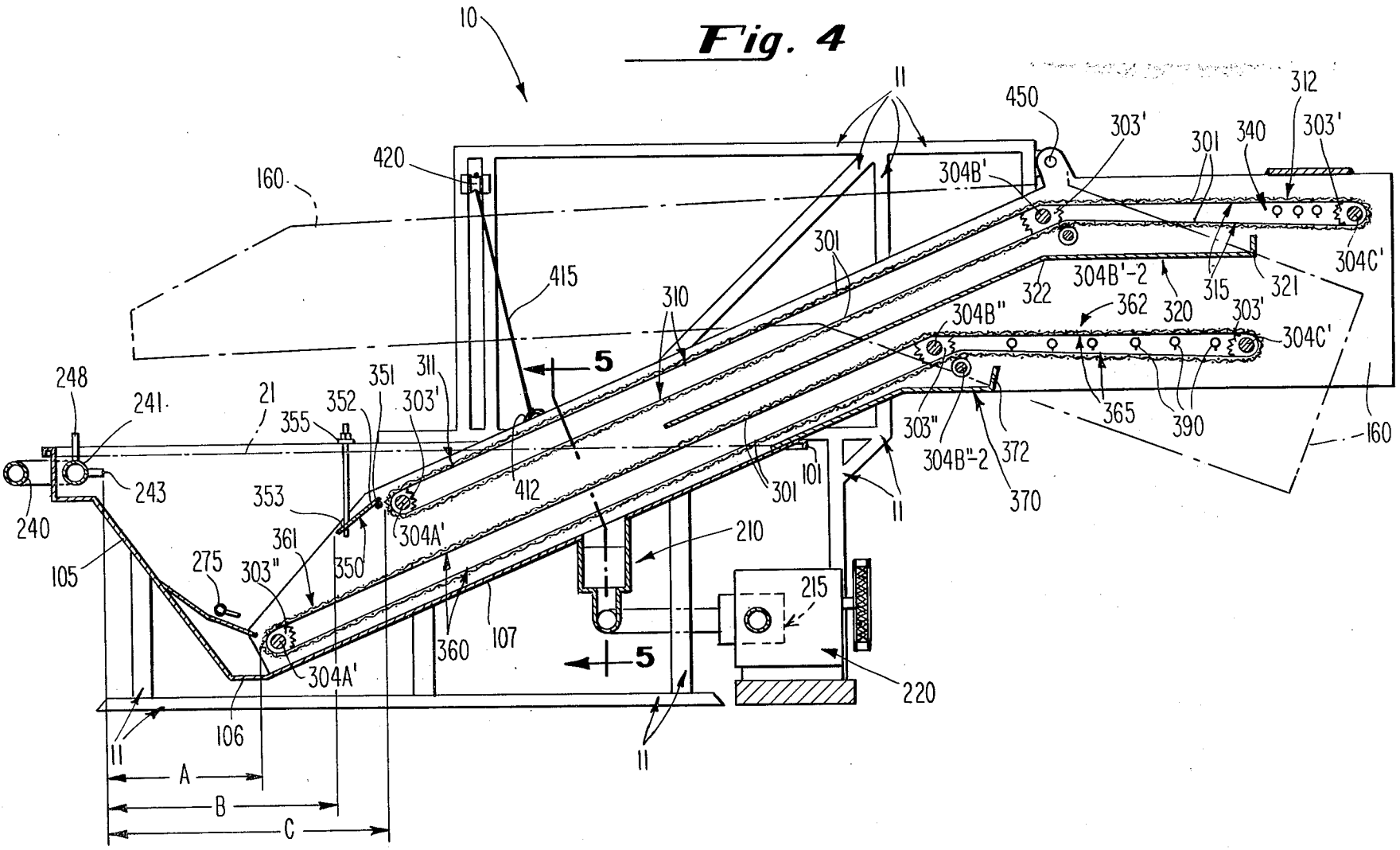
FIG. 4 is a sectional view of the apparatus of the present invention taken along the lines 4—4 of FIG. 2.

Discharge portion 150 of receptacle 100 contains conveyor system 300 which comprises a first conveyor belt 310 and second conveyor belt 360. First conveyor belt 310 contains a receiving portion 311 and discharge portion 312 which constitutes the remaining portion of first conveyor belt 310. Referring to FIG. 4, receiving portion 311 is shown slightly submerged beneath solution level 21 and it is inclined upwardly therefrom for carrying materials received by receiving portion 311 upwardly for removal out of solution 20. Second conveyor belt 360 is located beneath first conveyor 312 and also comprises a receiving portion 361 and a discharge portion 362, the latter of which is defined by that portion of conveyor 360 which extends from and without solution level 21. Second conveyor 360 functions to receive and collect materials not collected by first conveyor belt 310 and to convey same from receptacle 100. Second conveyor belt 360 is inclined upwardly in the manner of first conveyor belt 310 and is substantially parallel to discharge floor 107 of container 100. Conveyor belts 300 are housed in conveyor frame 160 and supported therein by shafts 304. Conveyor frame 160 is pivotally mounted to frame 11 by pivotal shaft 450.

More specifically, first conveyor belt 310 and second conveyor belt 360 are constructed of fryer chain with approximately ⅛" open mesh. This wire mesh belt functions to support the materials being conveyed from receptacle 100 while providing means to permit solution 20 to pass therethrough and back into receptacle 100. It is to be realized that the selection of type chain is dependent upon its ultimate use and particularly, the type and quantity of the materials to be conveyed from receptacle 100, and therefore, the size of open mesh, and the type of construction material will vary, as is known in the art. In the preferred embodiment, a wire cloth belt is utilized, and is supported by roller chain 301 which is in turn supported by key stocks (not shown) and sprockets 303' and 303", which are supported by shafts generally designated by numeral 304. Motor 305 drives shaft 305A which drives gear 306. Gear 306 is connected to gear 307' by chain 308'; gear 307' is integral with shaft 304C' which is integral with sprockets 303' which in turn drive first conveyor belt 310. Gear 307" is also integral with shaft 304C' and lies between gear 307' and sprockets 303'. Gear 307" is connected to gear 309 by chain 308"; gear 309 is integral with shaft 304C" which is integral with sprockets 303" which in turn drive second conveyor belt 360.

Figure 3:
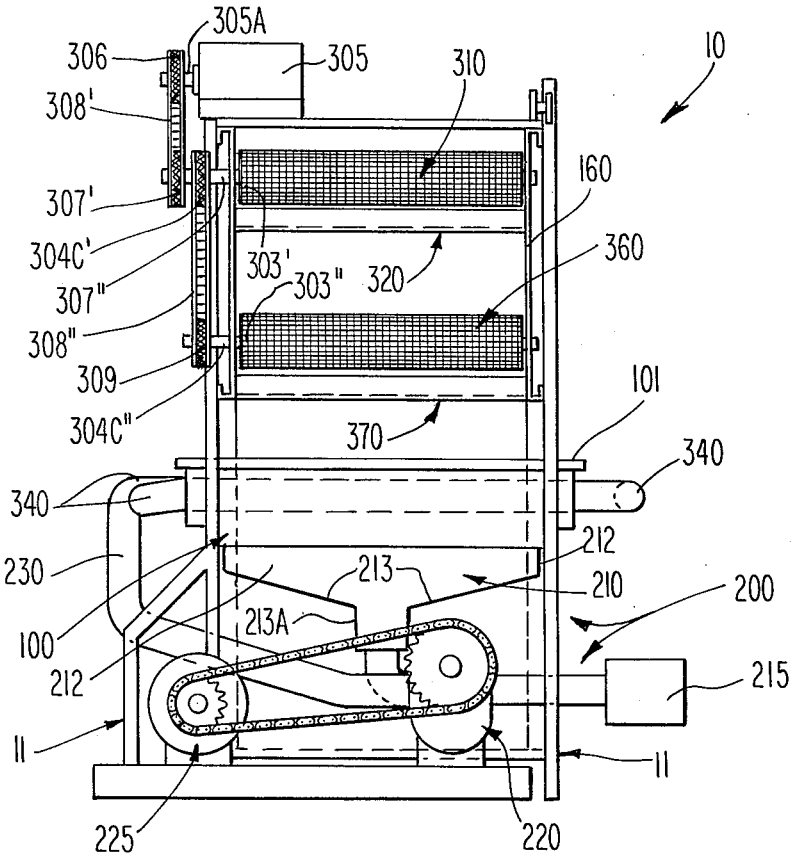
FIG. 3 is an end view of the discharge side of the apparatus of the present invention.

As is best illustrated in FIGS. 1 and 3, first conveyor belt 310 is supported by shafts 304A', 304B' and 304C' and second conveyor belt 360 is supported by shafts 304A", 304B" and 304C". It is to be noted that in one embodiment of apparatus 10 conveyor belts 310 and 360 incline upwardly from shaft 304A to shaft 304B and terminate at 304B where motor 305 will be mounted through a chain and gear mechanism, as described above (not shown), to drive conveyors 300. As thus far described, the first and second conveyor belts 310 and 360 will be complete and operable, and apparatus 10 may be placed in line for the production of raisins. In the preferred embodiment, however, first and second conveyor belts 310 and 360 are hipped and extend substantially horizontally from shafts 304B to 304C. Hipped portions 315 and 365 are substantially parallel to floor 106 and wire mesh conveyors are further supported by shafts 304B-2 and 304-B"-2. It has been found that hipped portions 315 and 365 respectively provide more time for the solution 20 to pass through conveyor belts 300.

Pan 320 is provided just beneath first conveyor belt 310 and secured to conveyor frame 160, to collect drippings of solution 20 from first conveyor belt 310 and to transmit same to receptacle 100. Referring now to FIG. 4, pan 320 is extended from a point just above solution level 21 to shaft 304B', in parallel relation with first conveyor belt 310. Thereafter, it extends in parallel relation to and beneath hipped portion 315 to a point which is approximately equidistant from shaft 304B' and 304C'. In the preferred embodiment, pan 320 is slightly inclined downwardly from end portion 321 to portion 322 to facilitate the transmission of solution 20 downwardly for redeposit in receptacle 100. Subsequent to end portion 321 and from end portion 321 to shaft 304C', is stem shaker 330 (FIG. 6) which is designed to collect the stems, waterberries, mold, and other waste materials conveyed from solution 20 up first conveyor belt 310 and along hipped portion 315 to discharge point 312. These materials are discharged into stem shaker 330 for transmission to a bin for storage and ultimate disposal (not shown).

First conveyor belt 310 including hipped portion 315 is manufactured from a continuous wire mesh belt as described above. Since constant operation tends to plug the wire mesh belt, cleaning system 340 is provided to remove such materials from first conveyor belt 310. Cleaning system 340 comprises three manifolds, 341 connected to a source of steam (not shown), 342 connected to a source of water (not shown), and 343 connected to a source of compressed air (not shown). Cleaning system 340 is disposed within hipped portion 315 and above lower belt 315B and below upper belt 315A. Each of the above manifolds 341, 342, and 343 may contain a series of nozzles (not shown) in fluid connection with said manifold to provide coverage for the entire width of hipped portion 315 of the wire mesh conveyor.

Second conveyor belt 360, including hipped portion 365, is comprised of a continuous belt as described above with respect to first conveyor belt 310. Discharge floor 107 acts to collect the solution which drips through the friar chain of first conveyor belt 360 up to the point where it becomes integral with side portions 101 of receptacle 100. Thereafter, pan 370 is attached to conveyor frame 160 and extends outwardly from and inclining upwardly in parallel relation to second conveyor belt 360, to point 371. Thereafter it follows and lies in substantially parallel relation to hipped portion 365 for receiving droplets of solution 20 which drip through second conveyor belt 360. Pan 370 extends horizontally from point 371 to pan end 372, which lies substantially below shaft 304B-2" of second conveyor belt 360. Thereafter, dewater shaker 380 (FIG. 6) is disposed beneath hipped portion 365 and substantially parallel to hipped portion 365 whereupon the raisins which are transported from receptacle 100 and up second conveyor belt 360 through hipped portion 365 are deposited into dewater shaker 380. Dewater shaker 380 also functions to receive materials removed from hipped portion 365 by cleaning system 390 which comprises a series of manifolds 391 which may comprise for example, air, water and steam lines connected to respective sources, as described above (system 340) and which further comprise in each manifold 391, a series of nozzles (not shown) which distribute the respective substance across the entire width of wire mesh conveyor of hipped portion 365. Cleaning systems 340 and 390 both function to remove debris from the open mesh fryer chain of conveyor system 300, and prevent blinding, and plugging which promotes efficient use and reuse of solution 20.

Referring now to FIG. 1, recirculating system 200 comprises suction box 210 which is in fluid connection with solution 20 contained in receptacle 100 and which is in fluid connection with recirculation pump 220 which pumps solution through fluid lines 230 and into manifold 240, the latter of which is in fluid connection with receptacle 100.

Figure 2:
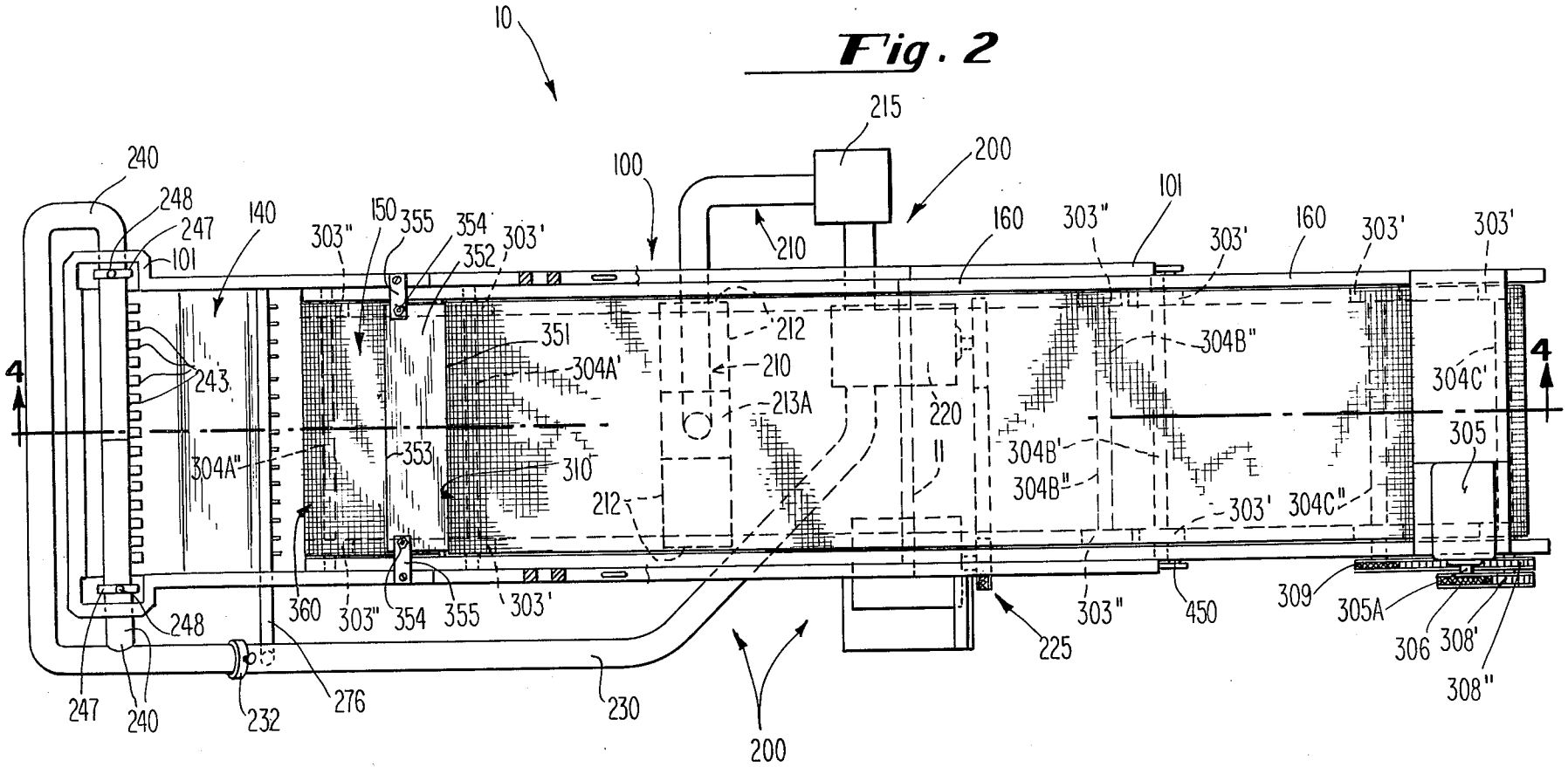
FIG. 2 is a sectional view of the present invention taken along the lines 2—2 of FIG. 1.
Figure 5:
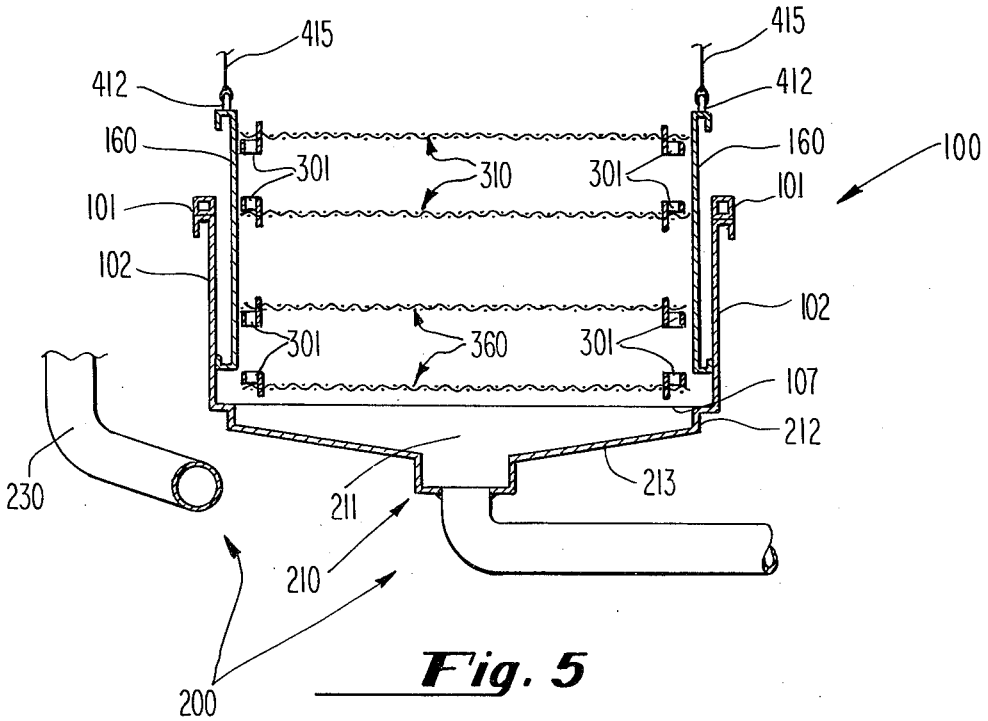
FIG. 5 is a sectional view illustrating the suction box of the present invention taken along the lines 5—5 of FIG. 4.

More specifically, and with reference to FIGS. 2, 3, and 4, suction box 210 lies substantially beneath discharge portion 150 of receptacle 100 and draws solution from receptacle 100. As is best seen in FIG. 5, suction box 210 traverses the width of floor discharge 107 and thereby evenly withdraws solution 20 from receptacle 100 throughout its width. Suction box 210 comprises suction manifold 211 having side walls 212 integral with bottom walls 213. Bottom walls 213 slope downwardly from side walls 213, forming mouth 213A which is integral with suction line 214 which is in fluid connection with suction filter 215. Suction filter 215 operates, as is known, to remove extraneous materials finding their way into suction manifold 211 and is in fluid engagement with pump 220 which operates in conjunction with pump motor 225 to draw solution 20 from receptacle 100 into suction manifold 211 through suction line 214 and suction filter 215 and also operates to move solution 20 through solution line 330 into manifold 340 at a predetermined rate of flow. Pump 220 is designed to circulate solution 20 throughout recirculation system 200 and is a standard pump operating in a manner known in the art. Pump 220 therefore circulates filtered solution 20 through circulation lines 230 and into a "T" 231 which is in fluid connection with circulation line 230, then into valve 232, into manifold 240 and into manifold delivery 341.

Manifold 240 includes controls (not shown) to regulate the rate of flow of the issuing stream of solution. Manifold delivery 241 is in fluid connection with manifold 240, the latter of which operates to uniformly distribute solution 20 at a uniform rate of flow throughout delivery manifold. Delivery manifold 241 is secured to receptacle 100 in receiving portion 140 thereof, in a position just beneath desired solution level 21. Manifold delivery 241, traverses the width of receptacle 100 and thereby uniformly distributes solution 20 throughout the width of receptacle 241. Delivery manifold 241 also contains a series of nozzles 243 in fluid connection with delivery manifold 241 for directing an issuing stream of solution 20 from the receiving portion 140 to discharge portion 150 of receptacle 100.

As thus far described, solution 20 is fed into manifold 240 from circulation lines 230 and enters manifold delivery 241 whereupon solution 20 is distributed evenly to nozzles 243, which produce a uniform issuing stream of solution 20 throughout the width of delivery manifold 241 and therefore, receptacle 100. In the preferred embodiment, manifold 240 is connected to manifold delivery 241 by a pair of slip joints 247. The slip joints 247 adjustably attach to and are in fluid relation with manifold delivery 341. Slip joints 247 permit nozzles 243 to be rotated by adjustment lever 248 through an arc preferable of at least about plus or minus 25 degrees from the position where nozzles 343 direct a substantially horizontal issuing stream of solution which is parallel to receptacle floor 106. This position is designated as zero degrees and the adjustment is hereafter designated by degree inclination of manifold 240. In this manner, adjustment level 248 may be utilized in the operation and while processing raisins to instantly adjust the issuing stream of solution 20, and more accurately separate the raisins from the cap stems, stems, waterberries, mold, and other waste materials.

Referring now to FIG. 1, it can be seen that the apparatus of the present invention further includes baffle plate 170 secured to receiving floor 105 of receptacle 100 at baffle weld 175. Baffle 170 is welded to receiving floor 105 in a manner such that it slopes downwardly from baffle weld 175 towards receiving portion 361 of second conveyor belt 360. In this manner, as raisins or other heavier materials are deposited into receiving portion 140 of receptacle 100 and sink towards receptacle floor 106, they will be received by baffle 170 which traverses the width of receptacle 100 and will thereby be directed to second conveyor belt 360. It is to be understood that baffle 170 is an optional feature. It has been found that it provides a convenient means of removing the materials from receptacle 100. In the preferred embodiment, 1" manifold 275 is placed in fluid connection with receptacle 100, above baffle 170. Manifold 275 contains a plurality of ⅜ inch nozzle openings with the nozzle openings being directed along and in substantially the same inclination or slope as baffle 170. Manifold 275 is in fluid connection with "T" 231 which is in fluid connection with feedline 276 flowing through valve 277 and into manifold 275. In the preferred embodiment, manifold 275, is constructed of a material inert with solution 20, (i.e. stainless steel), and operates to evenly distribute solution 20 throughout the nozzles of baffle 275.

In the operation of apparatus 10, valve 277 is closed throughout its operation and while manifold 240 is in operation. Valve 277 is opened at the termination of processing operations, or when otherwise needed to force any raisins or other materials received by baffle 170 onto the second conveyor belt 360 for removal from receptacle 100.

Apparatus 10 further includes hoist 400 which functions to raise conveyor belts 300 out of and from receptacle 100. Hoist 400 comprises winch 410 secured to frame 11 and utilizes cable 415 and a series of pulleys 420 (not all of which are shown). Cable 415 passes through pulleys 420 and is secured to cable anchors 412 which are secured to conveyor frame 160. Winch 410 may be activated by winding same to remove conveyor belts 300 from receptable 100 by pivoting same about shaft 450 which is integral with frame 11 and conveyor frame 160, as is best shown in FIG. 4. (See dotted lines).

In the preferred embodiment, first conveyor belt 310 is disposed within receptacle 100 to properly receive a portion of the free flowing materials such as mold, waterberries, and other waste. In many instances, however, slight adjustment of the position of first conveyor belt 310 would yield a substantial improvement in the liquid separation of the free flowing materials. First conveyor belt 310 is therefore provided with plow 350 which is integral with and supported by shaft 351, supported by frame 160 and secured in pivotal relation with plow end portion 352. End portion 353 of plow 350 is integral with a pair of adjustment rods 354 which are in threaded relation with end portion 353 and brackets 355 which are removably secured to rail 101. In operation of apparatus 10, plow 350 may be adjusted to the desired inclination, preferably plus or minus 20 degrees from its horizontal or zero degree position which is defined when plow 350 is substantially parallel to floor 106.

A negative inclination for manifold 240, as well as plow 350, indicates that each is adjusted or directed pivotally from their zero degree position toward floor 106.

As is described above, frame 11, and other external structures are fabricated from structural steel. In the preferred embodiment, the internal portions of receptacle 100, conveyor belts 300, manifolds and nozzles associated with manifold 240 and 275 including the related internal structure, baffle 170 and recirculating feed 230 are all fabricated of stainless steel. The nozzles are standard orfice nozzles and in the preferred embodiment have ¾" nozzle openings on 4" centers. Apparatus 10 may typically have the following dimensions for processing raisins at the stated tonnage per hour:

| | 4 T.P.H. | 10 T.P.H. |
|---|---|---|
| Receptacle Length: | 10' | 10' |
| Receptacle Width: | 36" | 80" |
| Receptacle Height: | 36" | 48" |
| Floor ( 106) Length: | 12' | 14' |
| Depth of Plow (below rails 101), 0° Inclination: | 8" | 8" |
| Depth of Manifold Nozzles (below rails 101), 0° Inclination: | 2" | 2" |
| Depth of Receiving Portion (below tails 101), of First Conveyor Belt: | 6" | 6" |
| Depth of Receiving Portion (below tails 101), of Second Conveyor Belt: | 30–36" | 30–36" |
| Distances A, B, and C from Manifold Nozzles to Receiving Portions of Second Conveyor Plow, and First Conveyor: A = 30"; C = 30–40" B = 36", | | |

To operate apparatus 10 in the most economical manner, solution recovery system 500 was developed. Referring to FIG. 6, it is seen that the raisins discharged from second conveyor belt 360 by hipped portion 365 onto dewater shaker 380 are treated by a series of dewater shaker tables 380 which in the preferred embodiment are "Syntron" tables, as are known in the art, preferably having a stainless steel bed. The action of shaker tables 380 promote removal of much of the separating fluid solution 20 in its original form, which is caught in pans (not shown) and may be collected and/or transported back to receptacle 100. In the preferred embodiment, there are a series of two shaker tables 380 designated as 380A, and 380B. As is illustrated, discharge portion 380A-1 and shaker table 380B are provided with a series of manifolds 382 and 384, thereover, supplying alternatively a fine mist of solvent, which in this case is water (382), followed by high velocity air jets (384) disposed in alternating relation thereafter. While manifolds 382 and 384 are illustrated as a single manifold unit, it is to be understood that each may represent a cluster of such mist or air manifolds. Finally, the raisins are treated with a bank of air jets (386) at discharge portion 380B-1. Each manifold provides a plurality of nozzles to cover the entire width of shaker tables 380. Shaker table 380A-1 and 380B also contains pans (not shown) to collect the rinse by the fine mist sprays and air jets. While this solution must be reconstituted, it has been found that by utilizing a fine mist of approximately three gallons per nozzle, per hour an ample amount of rinse and recovery of separating fluid solution is obtained without substantial reconcentrating.

The Method

In operation of apparatus 10, as thus far described, reference is now made to FIG. 6. FIG. 6 is a schematic view showing apparatus 10 as is incorporated "in-line" in a processing system for processing raisins. In processing of raisins, in apparatus 10, the raisins are passed through conveying station 3, then to conveyor 5 which is adjusted to properly feed materials into receptacle 100.

Thereafter, the materials of first conveyor 310 are discharged onto shaker table 330 and the materials of second conveyor 360 are discharged onto a series of dewater shaker tables 380 where they are treated and then once again, passed through fluming station 3 by discharging same on product feed line 600.

The materials discharged into receptacle 100 are those which may be characterized as materials which are loose and separable from the actual vines and may consist of some fruit with cap stems attached and some fruit with wood chips and other waste materials adhering thereto, but, for the most part, the raisins are separated from the other constituents which include stems, cap stems, wood chips, and other waste materials. Conveyor 5 transports the free flowing materials to a point which is disposed over the receiving portion 140 of receptacle 100 and at a critical and predetermined height above solution level 21. The free flowing fruit is thereby thrust into solution 20 at a velocity which promotes immersion into solution 20 in a manner to promote separation by specific gravity differential.

It is to be understood that the apparatus 10 of the present invention may be placed in various positions, "in-line" in the processing system for production of raisins. Typically, raisins are processed from grapes which are dried in the field and are then transported to wooden pallet bins for further drying. Thereafter, the processing of raisins occurs generally in the following steps:

(A) The raisins are initially cleaned in various mechanical apparatus, such as, tumblers, rolls, etc;

(B) They are subsequently processed by air cleaners;

(C) And in some instances, processed by using maximum air cleaning concentrated "blows";

(D) They then may be washed in water baths and dried; and/or (E) They are finally prepared for marketing, which in certain instances includes application of oil, and/or sugars.

In the examples which follow, raisins will be obtained at various points in their processing and designated as to what point they were obtained and treated by apparatus 10. Regarding step (C), it will be understood that when fruit to be used for commercial or industrial use is cleaned by violent air currents, 50% of the resultant product is very clean raisins and 50% is fruit containing a high proportion of unwanted extraneous matter. The clean fruit is generally separated from the dirty or "blows" and may be proessed in apparatus 10; likewise, the "blows" may be separately treated by apparatus 10.

As thus far described, apparatus 10 may be placed "in-line" after the above mentioned processing steps and the free flowing fruit conveyed to and discharged in the receiving portion 140 of receptacle 100 and removed by conveyor belts 300 whereby stems, cap stems, waterberries, and other waste materials are transported to bins for disposal and/or storage. In the preferred embodiment (seen in FIG. 6) the cleaned raisins, the product of second conveyor belt 360, are transported to solution recovery system 500.

It has been found that by thrusting the loose fruit into a solution of predetermined density, subjecting it to an issuing stream of solution from manifold 240, and maintaining the material in receptacle 100 for a predetermined dwell time, that the aforementioned constituents of the free flowing material seek predetermined levels within solution 20 and be separated and removed by conveyor belts 300.

Apparatus 10 may be "fine tuned" to promote a greater degree of separation in its operation. Adjustments are made while processing raisins by changing the following parameters: inclination of and/or rate of flow of the issuing stream of solution, the inclination of plow member 350, and/or the specific gravity of solution 20. Since and to the extent that the separation of constituents is effectuated by differences in specific gravity of the constituents and the solution 20, and given the relative difficulty in altering the specific gravity of solution 20, it is more desirable to adjust the above inclinations and flow rates, either individually, or in any combination of effectuate a change in the manner in which the free flowing materials react when immersed in solution 20. These adjustments are critical to the efficient operation of the present invention and may compensate for differences in temperature of solution, specific gravity of solution, and materials, feed rate of materials, and the like. It is to be understood that rigid control of the specific gravity of solution 20 would obviate these type of adjustments, but, since exact control of the specific gravity of the solution is difficult and since the specific gravity of the materials varies from lot to lot the aforementioned means for adjusting the apparatus provides an effective and efficient way to compensate for such changes, without shuting down.

In discussing the critical parameters of the present invention, it is to be understood that such parameters have general application to the separation of various materials. While they are discussed with reference to the processing of raisins and while limitations found to be best with respect to raisin processing are specifically set forth, it will be understood that the specific limitations found successful with respect to raisins, will change when applying the principles of the present invention in separation of other materials all within the scope of the present invention.

Heighth of Conveyor 15

It has been found that it was preferable for the free flowing materials to obtain a particular velocity prior to contacting solution 20 contained in receptacle 100. Generally it was found that the liquid separation of the materials are promoted by adjusting the height of conveyor 15 over solution level 21, to a point where the free flowing materials were caused to break apart and immerse themselves or sink into the solution, upon contacting solution 20. This critical velocity was not emperically calculated since it is interrelated with the specific gravity of the solution, the specific gravity of the constituent materials, the feed rate of the materials into receptacle 100, as well as the flow rate of the issuing stream of solution within receptacle 100, and the like. In the preferred embodiment, a heighth of about 18 inches or greater produced the most desirable results, given a specific gravity of waste materials of about 1.19 or less and that of raisins of about 1.28 or more. The upper limit of height will be determined based upon the maximum heighth which the materials could be accurately discharged into receiving portion 140 to properly interact with the issuing stream of solution to cause dispersion of the materials (testing indicated that proper interaction still occurred at a height of 36").

Type of Solution, Specific Gravity and Issuing Stream Parameters

It has been found that by regulating the specific gravity of solution 20 that constituent materials having only slight differences in specific gravity may be separated. In determing the specific gravity of the solution, the specific gravities of the various constituents of materials to be separated are calculated or approximated and the specific gravity of the solution is set such that certain of the materials become more buoyant and tend to float toward solution level 21, while the materials having a greater specific gravity tend to sink toward floor 106. For example, the specific gravities of raisins ranging from Greek-tunnel dried to fruit to be used in breakfast cereals, to Thompson seedless and the like are approximately 1.28 to 1.32 or greater. On the other hand, the average specific gravity of the heaviest stems are generally about 1.19. The specific gravity of the solution in the above example, therefore, would be set within the range of approximately 1.20 to 1.27. Preferably, the selected specific gravity of solution 20 would be in the middle of the aforementioned range or about 1.24. This would tend to produce an environment in which the raisins would quickly sink to the bottom while the stems would posses more buoyant properties and, therefore, tend to rise quickly toward the solution level 21. It is to be understood that solution 20 may comprise any type of solution having the required specific gravity, and, of course, being compatible with the end product being processed. Suitable solutions in the production of raisins include: sucrose, glucose, levulose, maltose, sodium chloride, calcium chloride, molasses, fruit juices, fruit extracts, or other saccharide. While it is preferable that saccharide type solutions be utilized in raisins, insofar as their compatibility with the final raisin product, the critical parameter is the specific gravity of the solution and not the type of solution. It may for example, be more preferable to utilize various saline or protein or emulsions solutions in applying the liquid separation process of the present invention to various vegetable separations, chicken from bone and gristle, and the like. In the processing of raisins, it has been found that the apparatus 10 of the present invention is successfully operated in a solution range of about 30 to 50% Brix or a specific gravity in the range of approximately 1.15 to 1.35. It was found that these ranges provided a suitable mode or environment for the liquid separation of the raisins from the other materials notwithstanding the above range was not within the specific gravities of the constituents (i.e. stems approx. 1.19—raisins approx. 1.28). This discrepancy is explained by the fine-tuning of apparatus 10 as described above.

As thus far described, the free flowing materials contact solution 20 which is issued from manifold 240 and described hereinabove as an issuing stream of solution. Solution level 21 is preset and in the preferred embodiment is aproximately 6 inches above plow 350 measured from an inclination of 0°; or approximately 1 to 2 inches above the issuing stream of solution measured from an inclination of manifold 340 of 0°. It has been found that given the selected solution at predetermined specific gravity and the aforementioned velocity of the free flowing materials that a particular dwell time is required; is defined as the time necessary to effectuate the separation of constituent materials. While this parameter is interrelated with the aforementioned combination of parameters, above, in the preferred embodiment, the rate of flow of the issuing stream of materials is set to yield a sufficient dwell time to effectuate sufficient separation of the constituent materials by controlling the flow rate of the issuing stream. This is readily adjustable and controlled by the operator of apparatus 10 through adjustment of pump speed control (not shown) of pump 220. In processing of raisins it was found that an issuing stream of about 100 to 120 gallons per minute provided a sufficient dwell time. The preferred range was 115 gallons per minute. Likewise, control of the angle of inclination of manifold 240 also effects dwell time. By directing the issuing stream more toward receptacle bottom 106 (a negative inclination) the operator in effect increases the dwell time of the materials in solution 20; contrariwise, if the issuing stream is directed more towards solution level 21 (a positive inclination).

TABLE I

| Operating Conditions | "A" After Initial Cleaning, Before Air Cleaners, or Wash | "B" After Air Cleaners, but Before Washing, Normal Settings on Air Cleaners | "C" same as "B" but Maximum Air Cleaning concentrated "Blows" | "D" Washed Berries Greek and Tunnel Dry Blend | "E" Cereal Raisins Just Prior to Oil Application |
|---|---|---|---|---|---|
| Solution Flow Rate | 117 gallons/min. | 117 gallons/min. | 117 gallons/min. | 117 gallons/min. | 117 gallons/min. |
| Time in Solution | 20 sec. | 20 sec. | 20 sec. | 20 sec. | 20 sec. |
| Manifold Jet Inclination | 2° Negative | 2° Negative | 5° Negative | 5° Negative | 8° Negative |
| Plow Inclination | 0° | 0° | 9° Negative | 18° Negative | 18° Negative |
| Specific Gravity of Solution | 1.232 | 1.280 | 1.282 | 1.282 | 1.285 |
| Solution Temperature, ° F. | 59 | 62 | 62 | 61 | 62 |
| Specific Gravity of Raisins | 1.32 + | 1.30 + | 1.32 + | 1.30 + | 1.32 + |
| Stems per 6 pounds, before separation | 464 | 27 | 546 | 34 | 5 |
| Stems per 6 pounds, after separation | 1.4 | 0 | 14 | 0 | 0 |
| Effectiveness of Stem Removal, Percent | 99.7% | 100% | 97.5% | 100% | 100% |
| Total Yield, Percent | 94% | 71% | 72% | 82% | 98% |

As was stated above, the operator may further fine-tune appartus 10 by adjusting plow 350. Much the same as manifold 240, above, and therefore, a similar explanation of his operation will not be repeated.

A dwell time of about 20 seconds was found to be acceptable.

The following examples are set forth to more clearly illustrate the principles and practices of the present invention to one skilled in the art. They are not intended to be restrictive, but are merely illustrative of the invention.

EXAMPLE 1

Initial testing was performed to prescreen the operational variables and determine various places where apparatus 10 would be most effective when placed "in-line" in a raisin processing system. Tote pan quantities of approximately 30 pounds per tote pan where hand-fed into apparatus 10 at a feed rate corresponding approximately to a commercial feed rate of 4 tons per hour.

Raisins were taken from various steps of their processing, corresponding to materials after processing as in steps A through E. The results of these tests are summarized in Table 1 below. The data reflects the most effective performance obtained, insofar as stem removal and the variable conditions recorded at the time of its achievement. The percent total yield was disproportionally low in these prescreening evaluations, however, later testing (see following examples), on a commercial scale, achieved significantly greater yields.

It was concluded that the best opportunities for production of commercial quantities of raisins would be obtained by placing apparatus 10 "in-line" after processing as in steps B through D.

EXAMPLE 2

10,080 pounds of cereal berries which had been rejected at the production line by quality control, were processed utilizing apparatus 10. A solution, derived from raisin extract was utilized. Feed was at a rate of 5.81 tons per hour. The materials discharged from first conveyor belt 310 had the following composition:

| | Count | Pounds | % of Rejects | % of Total Bin |
|---|---|---|---|---|
| Stems | 5617 | 1.83 | 9.0 | 0.169 |
| Waterberries, Mold and Substandard | — | 12.96 | 64.0 | 1.200 |
| Good Berries | — | 5.46 | 27.0 | 0.506 |
| Sub Total | — | 20.25 | 100.0 | 1.875 |

The materials discharged from second conveyor 360 had the following composition:

| | Count per 6 lb. sample | Estimated Count in lot, extrapolated | Pounds in bin lot | % of Processed bin, separated | % of original bin before separation |
|---|---|---|---|---|---|
| Stems | 4 | 706 | 0.26 | 0.025 | 0.024 |
| Waterberries, Mold and Substandard | — | — | 48.76 | 4.6 | 4.5 |
| Good Berries | — | — | 1010.0 | 95.4 | 94.0 |
| Sub Total | — | — | 1060.02 | 100 | 98.52 |
| Total, rejects and separated | | | | | 100.4 |

The results of separation utilizing apparatus 10 as outlined above are set forth in Table II below.

TABLE II

| | |
|---|---|
| Solution Flow Rate | 117 gallons/min. |
| Dwell Time (Time in Solution) | 20 sec. |
| Manifold Jet Inclination | 0° |
| Plow Inclination | 0° |
| Specific Gravity of Solution | 1.244 |
| Solution Temperature ° F. | 62 |
| Specific Gravity of Raisins | 1.32 |

TABLE II-continued

| | |
|---|---|
| Stems before Separation | 5,617 |
| Stems after Cleaning | 706 |
| %. Effectiveness of Stem Removal | 87.5 |
| total pounds waterberries, mold, substandard in bin: | |
| (a) Before Cleaning | 61.72 |
| (b) After Cleaning | 48.76 |
| (C) Percent Removal | 79% |
| Total Good Berries: | |
| (a) Before Separation | 1,016.5 |
| (b) After Separation | 1,011.0 |
| True Yield Percent | 99.5% |

EXAMPLE 3

A lot of 1,080 pounds of cereal berries which had been rejected at the production line were processed utilizing apparatus 10 under the same conditions as above with respect to Example 2, with the only change being that the plow was adjusted to an inclination of negative 18% to obtain a greater separation by increasing the materials collected on first conveyor belt 310. It was found that the true yield was a more realistic 98% and the processing resulted in a stem removal effectiveness in the order of about 95% and a mold, waterberries and substandards effectiveness in the order of about 65%.

In summarizing the data obtained in Examples 1, 2, and 3, it has been found that apparatus 10 will preferably be adjusted to obtain a yield in the order of from about 97 to 98% which in turn means that more good berries or raisins will be conveyed with the waste material up first conveyor belt 310 (approx. 2 to 3%). A slight decrease in the true yield, for example, has been found to result in a higher effectiveness of removal of stems, waterberries, mold, substandards, and other waste.

EXAMPLES 4 THROUGH 10

Apparatus 10 was used to process the following lots of raisins as described, hereinbelow, at a specific gravity ranging from 1.20 to 1.28 with solution level 21 held at 2.5 inches below rail 101, utilizing a plow inclination of negative 2° and an inclination of manifold 240 of negative 10°. Other parameters, including the solution flow rate, dwell time, and solution temperature, were maintained as were set forth hereinbefore in Table II (with respect to Example 2) except as otherwise indicated. Each of the following examples have been summarized in Table III below.

EXAMPLE 4

Cereal raisins were processed (raisins after good cleaning but before washing) with moldy fruit being added to the lot. First conveyor belt 310 removed 4.5 pounds of raisins, trash and stems and 6 pound sample of separated cereal raisins from second conveyor belt 360 was found to contain no (0) stems, 6 grams of mold, and 1 cap stem. The 4.5 pounds of material conveyed by first conveyor belt 310 were found to contain 807 stems, 1.1 pounds of mold, and substandard, and 3.2 pounds of good cereal berries. Before processing, the apparent stem content was on the order of 4 stems per 6 pounds; after processing, 0 stems per 6 pounds.

EXAMPLE 5

A 1,200 pound lot of raisins after good air cleaning and washing, was processed by apparatus 10 under the following conditions. The plow inclination was negative 3°, the inclination of manifold 240 was negative 4° and the solution temperature was 78°. The stem count prior to separation was 30 per 30 pound sample; and after separation, the count was 3 per 30 pound sample. A total of 1,154 stems were removed: 26.75 pounds of stems, waterberries, and mold were removed by the unit.

EXAMPLE 6

The materials removed by second conveyor 360 in Example 5, above, were rerun in apparatus 10, after the specific gravity of the solution was raised to 1.26. The results of the separation indicated that an additional 28 stems, several waterberries, but no appreciable good berries were removed. At 3 stems per 30 pounds of sample, there would have still been 118 stems in the cleaned berries resulting from Example 5 and rerun herein. Removal of 28 more stems would therefore reduce the number of stems to 90, and indicate 2.5 stems per 6 pound sample (0.5 stems per 6 pound sample).

EXAMPLE 7

Another lot of raisins after cleaning and washing, were processed in apparatus 10 as in Example 5, above, but at a specific gravity of 1.260. The feed rate was equal to 3 tons per hour. Prior to separation, the lab samples indicated 22 stems per 30 pound sample and after separation, the lab count indicated no (0) stems per 30 pound sample.

EXAMPLE 8

A lot of 1,200 pounds of the type raisins processed in Example 7 were processed under the same conditions as Example 7 and at a feed rate of 4 tons per hour. Prior to separation, lab samples indicated 17 stems per 30 pound sample and after processing, the count was zero (0) stems per 30 pound sample.

EXAMPLE 9

A 1,200 pound batch of raisins which had been subjected to good air cleaning yet had not been washed, were processed in apparatus 10 at a feed rate of 3.0 tons per hour and in a manner of Example 8, above, except that the solution had a specific gravity of 1.28.

EXAMPLE 10

A 1,200 pound lot of raisins of the type in Example 9 were processed under conditions of Example 8 at a rate of 3.5 tons per hour and in a solution having a specific gravity of 1.26.

| Examples | 4 | 5 | 6 | 7 | 8 | 9 | 10 |
|---|---|---|---|---|---|---|---|
| Feed Rate, Tons per Hour | 5.9 | 2.0 | 2.0 | 3.0 | 4.0 | 3.0 | 3.5 |
| Specific Gravity Solution | 1.20 | 1.234 | 1.26 | 1.26 | 1.26 | 1.28 | 1.26 |
| Pounds of Berries Processed | 1179 | 1200 | 1176 | 1100 | 1200 | 1200 | 1200 |
| Yield | 99.6 | 98.0 | — | 98.0 | 95.0 | 98.0 | 98.5 |
| Number of Stems Removed | 807 | 1182 | 28 | 806 | 680 | 500 | 520 |
| Percent Effectiveness of Stem Removal | 100 | 90 | — | 100 | 100 | 98 | 93 |

*See Test of Example 6

The above examples indicate that apparatus 10 as applied to the method of the present invention can be utilized in a highly effective manner for removal of stems; and additionally, mold, waterberries, and substandard defects, heretofore not removed in raisin processing. Moreover, chips of pallet-bin wood, were removed and additionally, it was found that cello-overwrap, cardboard fiber, and the like, were also removed.

It will be appreciated that the numerical values and ranges hereinbefore set forth in the examples are representative only of typical values and ranges which have been found to be acceptable in the method and apparatus as applied to raisin processing. Generally, the method and apparatus of the present invention is applicable to various forms of separation of materials as per the general relationships set forth hereinbefore. It will, of course, be obvious to those skilled in the art, that various modifications may be made in the method of the present invention and in the apparatus with which it is used without deparating from the spirit and scope of the present invention as set forth in the appended claims.

What is claimed is:

1. An apparatus for separation of materials comprising a mixture of constituents or groups of constituents which include a first and second group each differing in specific gravity, said mixture of materials being separable, based upon their respective differences in specific gravities, said materials being thrust into a receptacle to disperse same and break them apart, comprising:

a receptacle having a length and width and a receiving portion, said receptacle containing a homogeneous solution of predetermined density wherein said receptacle is filled with said solution to a predetermined level;

manifold means in operative engagement with said receiving portion of said receptacle and located beneath said solution level for issuing a stream of solution toward said discharge portion of said receptacle, and for varying the angle of inclination of said issuing stream of solution, said stream of solution issuing at a rate of flow which is substantially uniform throughout said width of said receptacle, and which impinges upon said materials further dispersing same and facilitating their separation into said first and second groups;

suction means in fluid engagement with said receptacle and said manifold means for removing said solution from said receptacle and distributing same to said manifold means;

first conveyor means disposed in said discharge portion of said receptacle having a receiving portion and a discharge portion, said receiving portion of said first conveyor means being submerged in said solution at a point just below said solution level, for removing said first group of materials; and second conveyor means disposed below said first conveyor means in said discharge portion of said receptacle for removal of said second group of materials.

2. An apparatus as in claim 1, wherein said manifold means further comprises:

a manifold feed in fluid connection with said suction means;

a pair of slip rings;

a rotatable delivery manifold having a width extending throughout said width of said receptacle and having two end portions, each in operative engagement with said slip rings, and each in fluid connection with said manifold feed;

a plurality of nozzles in fluid connection with said rotatable delivery manifold; whereby said inclination of said issuing stream from said nozzles is effected by rotating said delivery manifold about said slip rings and whereby said solution is supplied to said two end portions of said delivery manifold insuring issuance of said solution from each of said nozzles at a uniform flow rate throughout said width of said rotatable delivery manifold.

3. An apparatus as in claim 1, wherein said first and second conveyor means are pivotally mounted with said receptacle said apparatus further including hoist means mounted with said receptacle and operably engaging said first and second conveyor means for removing said first and second conveyor belts from said solution in said receptacle.

4. An apparatus as in claim 1, further including adjustable plow means operably engaging said receiving portion of said first conveyor means for selectively removing said first group of materials by varying the inclination of said plow means while maintaining said first conveyor means at said point below said solution level.

5. An apparatus as in claim 1, wherein said suction means further includes filter means disposed within said suction means for separation of said materials drawn into said suction means from said solution which is transmitted to said manifold means.

6. An apparatus as in claim 1, further comprising baffle means for collection and transmission of said materials to said second conveyor means wherein said baffle means further includes a baffle plate disposed in said discharge portion of said receptacle and positioned relative to said second conveyor means to promote removal of said second group of materials by said second conveyor means, and an auxiliary manifold integral with said receptacle and in operative engagement with said baffle plate and said suction means for issuing a second stream of solution along said collection plate and toward said second conveyor means.

7. An apparatus as in claim 1, wherein said first and second conveyor means are hipped and each have a receiving portion and a discharge portion wherein said receiving portion of said first and second conveyor means incline increasingly upwardly from said receptacle to the point where said conveyor means are hipped and thereafter extend substantially horizantally in parallel relation to each other and generally horizontal to said solution in said receptacle.

8. An apparatus as in claim 7, wherein said first conveyor means further includes a drip pan extending horizontally of said first conveyor means throughout the length of said receiving portion of said first conveyor means to the point where said first conveyor means is hipped whereupon said drip pan extends horizontal of said hipped portion of said first conveyor means.

9. An apparatus for separation of materials including raisins from a second group of materials comprising stems, cap stems, mold, waterberries, and other waste materials, said second group of materials being separable from said raisins, based upon their respective differences in specific gravities, comprising:

a receptacle having a length and width and a receiving portion, said receptacle containing a homogeneous solution of predetermined density wherein said receptacle is filled with said solution to a predetermined level;

manifold means in operative engagement with said receiving portion of said receptacle and located beneath said solution level for issuing a stream of solution toward said discharge portion of said receptacle and for varying the angle of inclination of said issuing stream of solution, said stream of solution issuing at a rate of flow which is substantially uniform throughout said width of said receptacle, and which impinges upon said materials further dispersing same and facilitating their separation into said first and second groups;

suction means in fluid engagement with said receptacle and said manifold means, for removing said solution from said receptacle and distributing same to said manifold means;

first conveyor means disposed in said discharge portion of said receptacle having a receiving portion and a discharge portion, said receiving portion of said first conveyor means being submerged in said solution at a point just below said solution level, for removing said second group of materials;

adjustable plow means operably engaging said receiving portion of said first conveyor means for selectively removing said second group of materials by varying the inclination of said plow means while maintaining said first conveyor means at a point below said solution level; and second conveyor means disposed below said first conveyor means in said discharge portion of said receptacle for removal of said raisins;

discharge collection means disposed beneath said first conveyor means for collection of said second group of materials from said first conveyor means; and recovery system means disposed beneath said second conveyor means for collection of said raisins, dewatering said raisins by removal of said solution from said raisins and separate collection of said dewatered raisins and said solution.

10. A method for a separation of raisins from a second group of materials comprising stems, cap stems, mold, waterberries, and other waste materials, said second group of materials being separable from said raisins, based upon their respective differences in specific gravities, wherein the method utilizes an apparatus having a receptacle containing a homogeneous solution, a rotatable manifold feed with a plurality of nozzles in fluid connection therewith, said rotatable manifold feed having means for varying the inclination of said issuing stream of solution, a first conveyor means for removing said second group of materials, adjustable plow means operatively engaging said first conveyor means for selectively removing said second group of materials by varying the inclination of said plow means, and second conveyor means disposed below said first conveyor means for removal of said raisins, said method comprising the steps of:

(a) dispersing said materials by thrusting same into said solution in said receptacle at a predetermined velocity whereupon they contact said solution and are thrust vertically into said solution, said solution having an effective specific gravity in the range between the specific gravity of said raisins and said second group of materials;

(b) impinging an issuing stream of solution upon said materials, said issuing stream of solution issuing from said nozzles at a predetermined flow rate and at a predetermined angle of inclination;

(c) removing said stems, cap stems, mold, waterberries, and other waste material from said receptacle by adjusting said plow means to an angle of inclination whereby said materials are carried up said first conveyor means and collected; and (d) removing said raisins from said receptacle by said second conveyor means.

11. A method as in claim 10, wherein the inclination of said adjustable plow means is in the range from about negative 20° to positive 15°.

12. A method as in claim 11, wherein the preferred inclination of said adjustable plow means is in the range of about 0° to negative 20°.

13. A method as in claim 10, wherein said specific gravity is in the range from about 1.18 to 1.35.

14. A method as in claim 10, wherein said apparatus further includes feed means for discharging materials into said receptacle, said feed means disposed at a heighth over said solution of at least about 18 inches whereby said materials are thrust into said receptacle at said predetermined velocity.

15. A method as in claim 10, wherein said flow rate is adjusted to yield a dwell time of said materials in said receptacle of about 20 seconds.

16. A method as in claim 10, wherein said inclination of said nozzles of said rotatable delivery manifold is in the range of from about negative 20° to positive 20°.

17. A method as in claim 16, wherein the preferred inclination of said nozzles is in the range from about 0° to negative 20°.

18. A method as in claim 10, wherein said issuing stream issues from said nozzles at a flow rate in the range from about 100 to 165 gallons per minute.

19. A method as in claim 18, wherein said preferred flow rate is in the range of from about 115 to 120 gallons per minute.

* * * * *